United States Patent [19]

Knapp et al.

[11] Patent Number: 4,639,064

[45] Date of Patent: Jan. 27, 1987

[54] ANTI-DECOUPLING RESISTING AND EMI SHIELDING MEANS FOR AN ELECTRICAL CONNECTOR ASSEMBLY

[75] Inventors: Anthony W. Knapp, Laurens; Dee A. Werth, Afton, both of N.Y.

[73] Assignee: Allied Corporation, Morristown, N.J.

[21] Appl. No.: 834,690

[22] Filed: Feb. 28, 1986

[51] Int. Cl.[4] ..... H01R 13/623

[52] U.S. Cl. ..... 339/89 M; 339/143 R; 339/DIG. 2

[58] Field of Search ..... 339/DIG. 2, 89 R, 89 C, 339/89 M, 90 R, 90 C, 143 R

[56] References Cited

U.S. PATENT DOCUMENTS

| | | | |
|---|---|---|---|
| 3,552,777 | 1/1971 | Heinrich et al. | 339/89 R |
| 3,786,396 | 1/1974 | Kemmer et al. | 339/89 R |
| 3,808,580 | 4/1974 | Johnson | 339/89 R |
| 3,917,373 | 11/1975 | Peterson | 339/89 R |
| 4,030,798 | 6/1977 | Paoli | 339/89 R |
| 4,109,990 | 8/1978 | Waldron et al. | 339/89 M |
| 4,326,768 | 4/1982 | Punako | 339/143 R |
| 4,423,919 | 1/1984 | Hillis | 339/143 R |
| 4,428,639 | 1/1984 | Hillis | 339/143 R |
| 4,462,653 | 7/1984 | Flederbach et al. | 339/89 R |
| 4,487,470 | 12/1984 | Knapp et al. | 339/89 M |
| 4,500,153 | 2/1985 | Mattingly, Jr. et al. | 339/89 M |
| 4,508,408 | 4/1985 | Shepler et al. | 339/89 M |
| 4,525,017 | 6/1985 | Schildkraut et al. | 339/89 M |
| 4,536,048 | 8/1985 | Schildkraut et al. | 339/89 M |
| 4,552,427 | 11/1985 | Landgreen | 339/DIG. 2 |

*Primary Examiner*—John McQuade

*Attorney, Agent, or Firm*—C. D. Lacina

[57] ABSTRACT

A spring member comprises a set of flat arcuate ring segments each having a flange portion extending perpendicularly from its opposite ends. The segments are assembled about a plug shoulder to resist rotation of a coupling nut thereabout only when each of a pair of connector shells are nearly mated, the segments being driven rearwardly by the receptacle and providing a substantially continuous 360° metal-to-metal EMI shield between the forward end face of the receptacle and the plug shoulder when the shells are fully mated. The flange portions are driven into detents disposed in the coupling nut flange and resist rotation only near full mate.

6 Claims, 7 Drawing Figures

FIG. 3
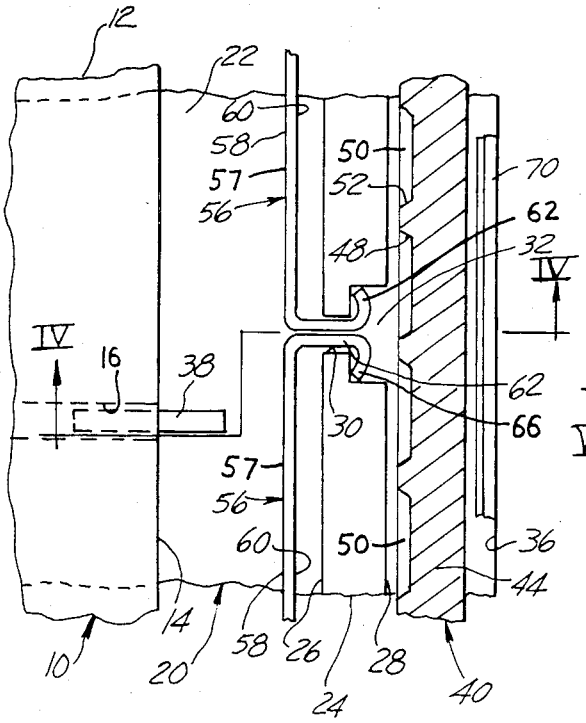
FIG. 5
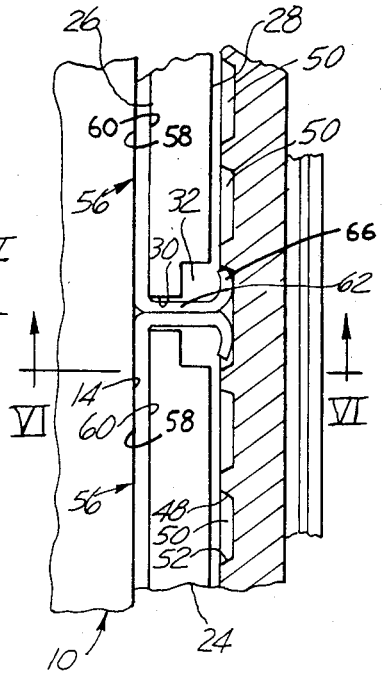
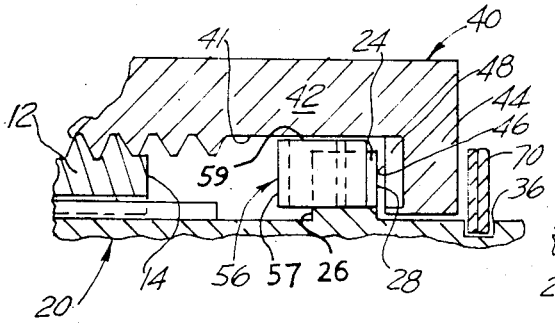
FIG. 4
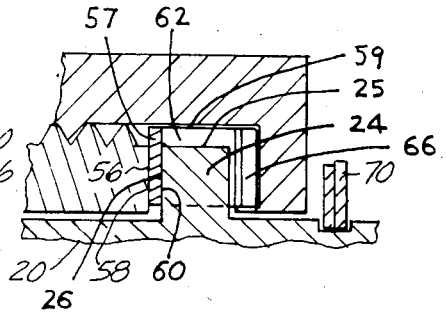
FIG. 6

ANTI-DECOUPLING RESISTING AND EMI SHIELDING MEANS FOR AN ELECTRICAL CONNECTOR ASSEMBLY

This invention relates to an electrical connector assembly having an arrangement for resisting rotation near full mate and for shielding the fully mated assembly from adverse electromagnetic frequency interference (EMI).

U.S. Pat. No. 4,109,990 issuing Aug. 29, 1978 to Waldron et al for an "Electrical Connector Assembly Having Anti-Decoupling Mechanism" mounts the ends of a straight beam on the inner endwall of a coupling nut so as to position a medial tooth on the beam to be tangent to and engage successive ratchet teeth radially disposed around the outer periphery of a shoulder on a plug shell to which the nut was rotatably mounted. While providing a good anti-decoupling solution, securement and placement of this beam requires that a mounting pin be staked into the coupling nut and causes the overall diameter of the connector assembly to increase. If the nut is rotated in either direction, the teeth will interengage to resist rotation and constant wear will occur. In some applications it would be desirable to limit rotation resisting engagement between teeth.

U.S. Pat. No. 4,326,768 issuing Apr. 28, 1982 to Punako for "Electrical Connector Grounding Strap Connection" teaches that a slotted metallic strap be wrapped around a plug shell outer periphery so that during mating with a receptacle shell a circumferential inner wall of the receptacle compresses the strap radially inward thereby completing a metal-to-metal path between the shells and shielding the assembly to prevent electromagnetic radiation from entering or leaving the assembly. As studies now show, there are many EMI paths between mated plug and receptacle shells. In particular in the above arrangement an unwanted EMI path could exist in the radial annulus formed between the ratchet teeth on the plug shell shoulder and the inner wall of the coupling nut and through the polarizing grooves extending longitudinally rearward from the front face of the receptacle shell when the front face is abutting the shoulder to provide a metal-to-metal contact. An EMI shielding arrangement which eliminates potential EMI paths without an increase in connector parts would be desirable.

The present invention relates to an electrical connector assembly of the type including mating cylindrical metallic plug and receptacle shells, and a cylindrical coupling nut including a radial flange rotatably mounted adjacent to a radial shoulder on the plug for threadable engagement with complementary thread on the receptacle shell whereby upon rotation of the coupling nut the shells are axially drawn together.

A combined rotation resisting and EMI shielding device is characterized by the coupling nut confronting a plurality of detents disposed in an axial face of the radial flange thereof against equiangularly spaced cavities disposed in an axial face of the plug shoulder, and three flat arcuate metallic ring segments being adapted to be assembled into a substantially continuous 360° annular spring member. The shoulder has an axial keyway communicating with each respective cavity, each keyway extending radially inward from the outer periphery of the shoulder. Each ring segment includes at its opposite ends a flange portion that extends perpendicularly therefrom to a tail portion with the flange portions from adjacent ring members being received in one of the keyways and cooperating when assembled about the plug to define a set of three pairs of angularly spaced tail portions, each flange portion being slidably mounted in one respective keyway and adapted to slidably move from a first position wherein its respective tail portion is nested in a respective cavity and be driven axially rearward and into engagement with respective of the detents.

During initial coupling rotation the annular ring segments do not impede rotation because the tail portions are nested in their respective cavities. As nearly fully mate is approached, the flat arcuate segments are engaged by the front end face of the receptacle shell which drives the ring segments axially rearward towards the forward face of the plug shoulder. Further advance causes the tail portions to be driven axially rearward from their cavities whereby to engage the detents and resist rotation. Further coupling advance of the receptacle front end face causes the flat top and bottom faces of the ring segments to be in a substantially continuous 360° metal-to-metal abutment with the forward face of the plug shoulder and the receptacle front end face whereby to seal against EMI leakage.

An advantage of this arrangement is that a simple spring device provides both EMI shielding and rotation resistance and, to reduce metal wear, utilizes rotation resistance only during a limited portion of the coupling operation. Further, mounting pins and the like are eliminated, the overall diameter of the assembly is reduced, and traditional circumferential grounding straps may still be utilized. One way of carrying out the invention is described below with reference to the drawings which illustrate one specific embodiment of this invention in which:

FIG. 3 is a partial top view of the connector assembly and the coupling nut partially cut open showing the shells being interconnected.

FIG. 4 is a partial side view in section of the connector assembly taken along lines IV—IV of FIG. 3.

FIG. 5 is a partial top view of the fully mated connector assembly with the coupling nut partially cut open to show the interconnection.

FIG. 6 is a partial side view in section of the mated connector assembly taken along lines VI—VI of FIG. 5.

Figures 1, 2, 7:
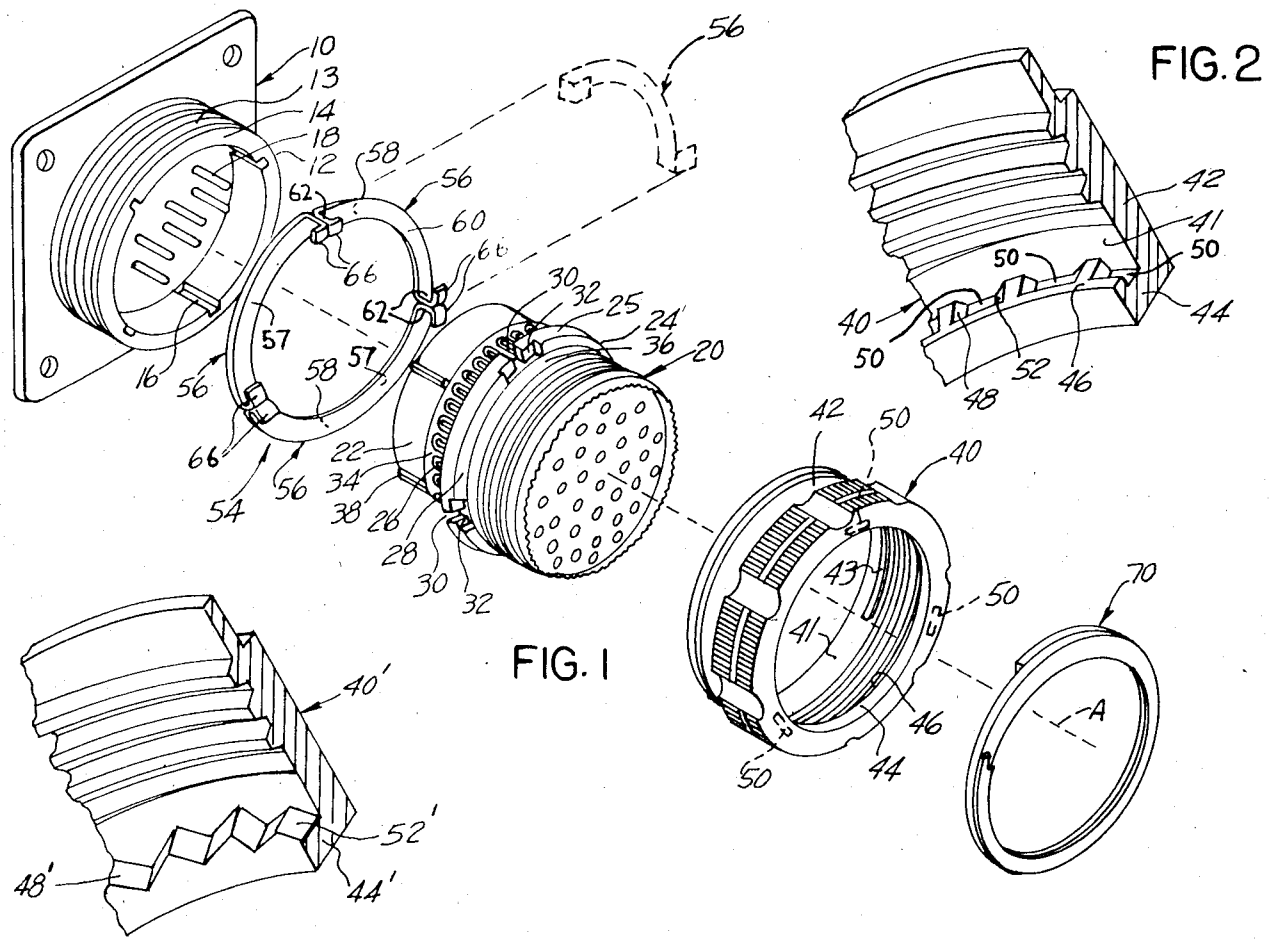
FIG. 1 is an exploded view of an electrical connector assembly.
FIG. 2 is an enlarged partial section view of a coupling nut shown in the assembly of FIG. 1.
FIG. 7 is a view of a coupling nut.

Referring now to the drawings, FIG. 1 shows an exploded view of an electrical connector assembly aligned along its primary axis "A" for mating and comprises a cylindrical metallic receptacle shell 10 having a forward end portion 12 thereof provided with external thread 13 and terminating in a flat forward end face 14, a cylindrical metallic plug shell 20 having a forward end portion 22 sized to telescopically interfit within the receptacle for mating and a medial radial shoulder 24, and a coupling nut 40 adapted to rotatably mount to the plug shell, the coupling nut having an inward radial flange 44 to seat rearwardly of and in confronting relation to the shoulder and a cylindrical shell 42 having on its inner wall 41 internal thread 43 for engaging with the receptacle thread whereby rotation of the coupling nut and engagement between the thread draws the shells together. A set of keys 38 on the plug are adapted to be received within corresponding longitudinal grooves 16 in the receptacle whereby to orient the shells for mating and constrain the shells for axial movement during mating. The plug and receptacle shells carry a plurality of contacts which are mated upon mating of the shells. Pin-type contacts 18 are shown in the receptacle for mating with socket-type contacts (not shown) in the plug. A retaining ring 70 is sized to fit in an annular groove 36 in the plug shell to captivate the radial flange of coupling nut for rotation thereabout.

A metallic annular spring member 54 is adapted to be assembled from three ring segments 56 and mounted to the radial shoulder 24 on the plug shell for axially slidable fitment thereto, one of the ring segments being shown removed but in phantom about the plug shell. Each ring segment 56 comprises a flat arcuate plate portion 57 having flat top and bottom surfaces 58, 60, an outer circumferential face 59, and a flange portion 62 extending perpendicularly from each of its opposite ends in a direction rearwardly from the bottom surface 60. When assembled the plate portions are generally disposed in a plane perpendicular to the axis of rotation and the flange portions from adjacent ring segments abut together along their axial faces and cooperate to define three pairs of angularly spaced axially extending tail portions 66.

The radial shoulder 24 has an outer periphery 25, a forwardly facing annular face 26, and a rearwardly facing annular face 28 with each annular face being in parallel planes separated by a predetermined axial distance and each plane being perpendicular to the primary axis "A" (i.e., the axis of rotation). The shoulder 24 further includes a set of three angularly spaced cavities 32 each in the rearward annular face 28, and a set of three keyways 30 each extending radially inward from the outer periphery 25 and extending axially between the annular faces 26, 28 to terminate in one respective cavity 32. The keyways 30 receive the flange portions 62 and the cavities 32 receive the tail portions 66 when the ring segments are dropped radially downward about the outer periphery 25 of the shoulder. Three cavities are shown (in phantom) each being disposed about the shoulder at 120° intervals.

The radial flange 44 on the coupling nut 40 defines an inner endwall 46 which is adapted to confront the rearwardly facing annular face 28, the endwall including a plurality of detents 50 each disposed equiangularly therearound. The endwall is generally disposed in a plane perpendicular to the axis of rotation.

FIG. 2 shows detail of the coupling nut 40 and shows the endwall 46 as being axially facing and including a contiguous plurality of equiangularly spaced detents 50. Each detent would include a pair of cam surfaces 48,52 the angles of which are measured in a plane disposed perpendicular to the connector axis of rotation. The cam surface disposed in the direction of coupling rotation would not be as steep as would be the cam surface in the direction of uncoupling rotation whereby to facilitate forward coupling rotation of the coupling nut but resist uncoupling rotation which would disturb the EMI shielded condition when the shells are mated.

FIG. 3 shows initial coupling rotation with the forward end face 14 of the receptacle shell being drawn towards the forwardly facing annular face 26 of shoulder 24 around the plug shell 20. The coupling nut 40 has been cut apart to show the radial flange 44 (in section) being captivated behind the rearwardly facing annular face 28 of the shoulder. The key 38 on the plug 20 has been received in the longitudinal groove in the inner wall of the receptacle shell 10 to constrain the shells into axial movement during rotation of the coupling nut.

The ring segments 56 have been assembled into a substantially continuous annular spring member 54 and slidably mounted in a loose fit about the plug shell with the respective flat plate portions 57 axially spaced from the forwardly facing annular face 26. During initial coupling rotation each adjacent pair of flange portions 62 are captivated within their respective keyway 30 such that the pair of tail portions 66 formed by their assembly is nested within one respective cavity 32, the tail portions at this point being spaced from and not engaging with the detents 50 or resisting rotation.

FIG. 4 shows a side view in section of the initial coupling shown in FIG. 3. The outer circumferential faces 59 from each of the flat arcuate plate portions 57 of the ring segments 56 clearance fit adjacent to the inner wall 41 of the coupling nut to eliminate any non-metallic radial gap that might exist therebetween. The outer periphery 25 of the shoulder would also be clearance fit about the inner wall but for the purposes of illustration is shown spaced radially inward therefrom. Upon final mated relation between the shells of the forward annular face 26 of the shoulder 24 will be sealed by a substantially continous 360° metal-to-metal contact.

FIG. 5 shows the final mated relation wherein the forward end face 14 of the receptacle abuts each of the top faces 58 of the ring segments 56 and drives the bottom face 60 of each ring segment 56 into abutment against the forward annular face 26 of the plug shell to complete a substantially continuous 360° metal-to-metal seal therearound. The tail portions 66 resiliently deform in one of the detents 50. Depending on the extension of the flange portion 62 from which the tail portion depends, the tail portion could be rearwardly deformed into its respective cavity 32. Further, depending on their axial length, the angular separation between the cam surfaces in each detent, the cavity and keyway configuration, and the shape of the tail portion free end available for resilient deformable collapse, the flange portions 62 from adjacent pairs of ring segments 56 would laterally spread apart when axially compressed within the detent.

FIG. 6 shows a side view in section of the mated relation corresponding to FIG. 5 and shows the substantially continuous 360° metal-to-metal seal formed against the forward annular face 26 of the shoulder 24 and the front face 14 of the receptacle shell.

FIG. 7 is an alternate coupling nut configuration and shows a coupling nut 40' having a contiguous plurality of equiangularly disposed, V-shaped, ratchet teeth 52' adapted to be engaged by the resiliently compressible tail portions, each tooth 52' being disposed in the flange 44' and defining intersecting cam faces 48'.

Having described the invention what is claimed is:

1. An electrical connector assembly comprising a pair of cylindrical shells the forward end portions of which interfit for mating, a rotatable coupling nut for coupling the shells together, and means operative only near full mate for resisting rotation of said coupling nut, one shell including a forwardly and a rearwardly facing annular face and the other shell terminating in a foward end face which during coupling rotation is advanced towards the forwardly facing annular face, said coupling nut having an annular endwall adjacent to the rearwardly facing annular face, said means being characterized in that an annular spring member is slidably disposed about said one shell, said endwall includes a plurality of angularly spaced detents, and said rearwardly facing annular face includes a cavity, said spring member comprising a flat annulus adapted to be sandwiched between the forward end face and the forwardly facing annular face and including an axially extending flange portion which is initially adapted to seat within the cavity so as not to impede rotation and at full mate as a result of the forward end face driving the flat annular against the forwardly facing annular face is driven axially rearward to be deformed within one of the detents whereby to resist rotation.

2. The connector assembly as recited in claim 1 wherein said spring member is characterized by a plurality of like ring segments each comprising a flat arcuate plate portion having opposite ends terminating in a flange portion extending perpendicularly rearward therefrom and terminating in a tail portion, the plurality of ring segments assembling to form a substantially continuous 360° annulus with the flange portions from adjacent pairs of ring segments being abutted, each said tail portion fitting within a respective cavity and being drivable rearwardly against and into a detent in the endwall of said coupling nut to resist rotation of the nut relative to the shells.

3. An electrical connector assembly comprising a metallic plug shell having a pair of annular faces, a metallic receptacle shell having a forward end face, and a coupling nut rotatably mounted on said plug shell for drawing the shells together and into mated relation, said coupling nut having an endwall adapted to be drawn towards one annular face as a result of coupling rotation of the nut, said faces and said endwall being in parallel planes generally perpendicular to the central axis of the plug shell, characterized by means operative near full mate of the shells for aiding in shielding elements within the connector assembly from EMI and for resisting rotation of the coupling nut, said means comprising a plurality of detents spaced around said endwall, a cavity disposed in said one annular face, a keyway extends between said annular faces and terminates in said cavity, and a metallic annular plate having substantially flat top and bottom surfaces and a resilient spring finger depending therefrom is mounted on the plug shell, the flat plate surfaces being sandwiched between the forward end face of the receptacle shell and the other annular face with the spring finger extending axially through the keyway, full mating driving the plate and its spring finger rearwardly so that the plate has its top and bottom surfaces against and in substantially 360° continuous metal-to-metal abutment, respectively, with the forward end face of the receptacle shell and the other annular face on the plug shell whereby to shield axial EMI paths through the shells and the spring finger is resiliently deformed in one of the detents whereby to resist rotation once nearly full mate is achieved.

4. The connector assembly as recited in claim 3 wherein each said detent includes a forward cam and a rearward cam each cam formed at different angles relative to a plane normal to the axis of rotation of said coupling nut with one said angle being steeper than the other, and said spring finger comprises a pair of laterally spreadable axial leafs each terminating in a tulip shaped end, the shaped ends being adapted to resiliently compress within respective of the detents to impede rotation upon contact with the cams.

5. A separable electrical connector comprising two tubular shells one shell being adapted to telescope within the other shell during mating therewith, said one shell having a radial shoulder and said other shell having a forward end face, a coupling nut having a radial flange rotatably mounted on said one shell adjacent to said shoulder, and means operative near full mate for resisting rotation of said nut, said rotation resisting means characterized by said shoulder including a cavity and said flange including a plurality of detents, said cavity being disposed in confronting relation with said flange, an axial keyway extending through said shoulder and communicating with said cavity, and a resilient spring finger having a body portion being constrained to slide in said keyway and a compressible end portion extending into the cavity associated therewith and adapted to be driven rearwardly therefrom and into respective of said detents, initial coupling rotation not being resisted by the spring finger but as full mate is approached the forward end face of said other shell advances against the forward end portion to drive the compressible end portion towards the flange and into engagement with successive of the detents whereby to be resiliently compressed therewithin and resist rotation.

6. The electrical connector assembly as recited in claim 1 further characterized by shielding means for aiding in shielding elements within the assembly from axially propagating EMI interference, said shielding means comprising the shells and the spring member being of metal, said annulus at full mate providing substantially continuous 360° metal-to-metal shielding abutment with the forward end face of the other shell and the forwardly facing annular face of the one shell whereby to provide EMI shielding.

* * * * *